US007183984B2

(12) United States Patent
Jarmuszewski et al.

(10) Patent No.: US 7,183,984 B2
(45) **Date of Patent: *Feb. 27, 2007**

(54) MULTIPLE-ELEMENT ANTENNA WITH PARASITIC COUPLER

(75) Inventors: Perry Jarmuszewski, Waterloo (CA); Yihong Qi, Waterloo (CA); Ying Tong Man, Kitchener (CA)

(73) Assignee: Research In Motion Limited, Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/122,455

(22) Filed: May 5, 2005

(65) Prior Publication Data

US 2005/0200537 A1 Sep. 15, 2005

Related U.S. Application Data

(63) Continuation of application No. 10/462,440, filed on Jun. 16, 2003, now Pat. No. 6,891,506.

(60) Provisional application No. 60/390,491, filed on Jun. 21, 2002.

(51) Int. Cl.
*H01Q 1/24* (2006.01)

(52) U.S. Cl. ..... 343/702; 343/803; 343/833; 455/575.7

(58) Field of Classification Search ..... 343/702, 343/803, 833, 834, 700 MS, 795; 455/575.7
See application file for complete search history.

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altamayer |
| 3,622,890 | A | 11/1971 | Fujimoto et al. |
| 3,683,376 | A | 8/1972 | Pronovost |
| 4,024,542 | A | 5/1977 | Ikawa et al. |
| 4,074,270 | A | 2/1978 | Kaloi |
| 4,403,222 | A | 9/1983 | Bitter, Jr. et al. |
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |

(Continued)

FOREIGN PATENT DOCUMENTS

| | | |
|---|---|---|
| EP | 0543645 | 5/1993 |

(Continued)

OTHER PUBLICATIONS

PCT International Preliminary Examination Report, Dec. 23, 1998.

(Continued)

*Primary Examiner*—Michael C. Wimer
(74) *Attorney, Agent, or Firm*—Jones Day; Krishna K. Pathiyal; Robert C. Liang

(57) ABSTRACT

A multiple-element antenna for a multi-band wireless mobile communication device is provided. The multiple-element antenna includes a first antenna element, a second antenna element positioned adjacent the first antenna element, and a parasitic coupler positioned adjacent the first antenna element and the second antenna element. In one embodiment, the first and second antenna elements have respective first and second operating frequency bands, and electromagnetically couple with each other and with the parasitic coupler when the multiple-element antenna is operating in the first or second operating frequency band. The first and second antenna elements are configured to be connected to first and second transceivers in a wireless mobile communication device in an alternate embodiment.

29 Claims, 6 Drawing Sheets

U.S. PATENT DOCUMENTS

| | | | |
|---|---|---|---|
| 4,590,614 | A | 5/1986 | Erat |
| 4,692,769 | A | 9/1987 | Gegan |
| 4,730,195 | A | 3/1988 | Phillips et al. |
| 4,839,660 | A | 6/1989 | Hadzoglou |
| 4,847,629 | A | 7/1989 | Shimazaki |
| 4,857,939 | A | 8/1989 | Shimazaki |
| 4,890,114 | A | 12/1989 | Egashira |
| 4,894,663 | A | 1/1990 | Urbish et al. |
| 4,975,711 | A | 12/1990 | Lee |
| 5,030,963 | A | 7/1991 | Tadama |
| 5,138,328 | A | 8/1992 | Zibrik et al. |
| 5,214,434 | A | 5/1993 | Hsu |
| 5,218,370 | A | 6/1993 | Blaese |
| 5,227,804 | A | 7/1993 | Oda |
| 5,245,350 | A | 9/1993 | Sroka |
| 5,257,032 | A | 10/1993 | Diamond et al. |
| 5,347,291 | A | 9/1994 | Moore |
| 5,373,300 | A | 12/1994 | Jenness et al. |
| 5,420,599 | A | 5/1995 | Erkocevic |
| 5,422,651 | A | 6/1995 | Chang |
| 5,451,965 | A | 9/1995 | Matsumoto |
| 5,451,968 | A | 9/1995 | Emery |
| 5,457,469 | A | 10/1995 | Diamond et al. |
| 5,489,914 | A | 2/1996 | Breed |
| 5,493,702 | A | 2/1996 | Crowley et al. |
| 5,541,609 | A | 7/1996 | Stutzman et al. |
| 5,684,672 | A | 11/1997 | Karidis et al. |
| 5,701,128 | A | 12/1997 | Okada et al. |
| 5,767,811 | A | 6/1998 | Mandai et al. |
| 5,821,907 | A | 10/1998 | Zhu et al. |
| 5,841,403 | A | 11/1998 | West |
| 5,870,066 | A | 2/1999 | Asakura et al. |
| 5,872,546 | A | 2/1999 | Ihara et al. |
| 5,903,240 | A | 5/1999 | Kawahata et al. |
| 5,966,098 | A | 10/1999 | Qi et al. |
| 5,973,651 | A | 10/1999 | Suesada et al. |
| 5,977,920 | A | 11/1999 | Hung |
| 5,990,838 | A | 11/1999 | Burns et al. |
| 6,008,773 | A | 12/1999 | Matsuoka et al. |
| 6,028,568 | A | 2/2000 | Asakura et al. |
| 6,031,505 | A | 2/2000 | Qi et al. |
| 6,034,639 | A | 3/2000 | Rawlins et al. |
| 6,140,966 | A | 10/2000 | Pankinaho |
| 6,329,951 | B1 | 12/2001 | Wen et al. |
| 6,335,706 | B1 | 1/2002 | Elliot |
| 6,337,667 | B1 | 1/2002 | Ayala et al. |
| 6,408,190 | B1 | 6/2002 | Ying |
| 6,456,249 | B1 | 9/2002 | Johnson et al. |
| 6,515,634 | B2 | 2/2003 | Desclos et al. |
| 6,664,930 | B2 | 12/2003 | Wen et al. |
| 6,781,548 | B2 | 8/2004 | Wen et al. |
| 6,791,500 | B2 | 9/2004 | Qi et al. |
| 6,891,506 | B2 * | 5/2005 | Jarmuszewski et al. ..... 343/702 |
| 2001/0001554 | A1 | 5/2001 | Oshiyama |
| 2001/0050643 | A1 | 12/2001 | Egorov et al. |
| 2001/0101380 | | 8/2002 | Pruss et al. |
| 2002/0140607 | A1 | 10/2002 | Zhou |
| 2003/0011521 | A1 | 1/2003 | Edimo et al. |

FOREIGN PATENT DOCUMENTS

| | | |
|---|---|---|
| EP | 0571124 | 11/1993 |
| EP | 0765001 | 3/1997 |
| EP | 0814536 | 12/1997 |
| EP | 0892459 | 1/1999 |
| EP | 1018779 | 7/2000 |
| EP | 1172885 | 1/2002 |
| EP | 1189304 | 3/2002 |
| EP | 1296410 | 3/2003 |
| EP | 1304765 | 4/2003 |
| GB | 2330951 | 5/1999 |
| JP | 55147806 | 11/1980 |
| JP | 5007109 | 1/1993 |
| JP | 5129816 | 5/1993 |
| JP | 5267916 | 10/1993 |
| JP | 5347507 | 12/1993 |
| JP | 06097712 | 4/1994 |
| JP | 6204908 | 7/1994 |
| WO | 8809065 | 11/1988 |
| WO | 9638881 | 5/1996 |
| WO | 9733338 | 9/1997 |
| WO | 9812771 | 3/1998 |
| WO | 9903166 | 1/1999 |
| WO | 9925042 | 5/1999 |
| WO | 0001028 | 1/2000 |
| WO | 0171844 | 9/2001 |
| WO | 0178192 | 10/2001 |
| WO | 019236 | 11/2001 |
| WO | 02054539 | 7/2002 |
| WO | 03047031 | 6/2003 |

OTHER PUBLICATIONS

PCT International Search Report, Oct. 12, 2001.

Patent Abstracts of Japan, vol. 017, No. 264 (E-1370), May 24, 1993 & JP 05 007109 (Mitsubishi Electric Corp.), Jan. 14, 1993, abstract; figures 1-3, 5-7.

Patent Abstracts of Japan, vol. 018, No. 188 (E-1532), Mar. 31, 1994 & JP 05 347507 A (Junkosha Co Ltd), Dec. 27, 1993, abstract; figures 1-19.

* cited by examiner

MULTIPLE-ELEMENT ANTENNA WITH PARASITIC COUPLER

This application is a Continuation of U.S. patent application Ser. No. 10/462,440, filed Jun. 16, 2003 now U.S. Pat. No. 6,891,506. U.S. patent application Ser. No. 10/462,440 claims priority from U.S. Provisional Patent Application No. 60/390,491 filed Jun. 21, 2002 and entitled "Multiple-Element Antenna With Parasitic Coupler." The entirety of these priority applications are incorporated herein by reference.

FIELD OF THE INVENTION

This invention relates generally to the field of antennas. More specifically, a multiple-element antenna is provided that is particularly well-suited for use in wireless communication devices such as Personal Digital Assistants, cellular telephones, and wireless two-way email communication devices.

BACKGROUND OF THE INVENTION

Mobile communication devices ("mobile devices") having antenna structures that support communications in multiple operating frequency bands are known. Many different types of antennas for mobile devices are also known, including helix, "inverted F", folded dipole, and retractable antenna structures. Helix and retractable antennas are typically installed outside a mobile device, and inverted F and folded dipole antennas are typically embedded inside a mobile device case or housing. Generally, embedded antennas are preferred over external antennas for mobile devices for mechanical and ergonomic reasons. Embedded antennas are protected by the mobile device case or housing and therefore tend to be more durable than external antennas. Although external antennas may physically interfere with the surroundings of a mobile device and make a mobile device difficult to use, particularly in limited-space environments, embedded antennas present fewer such challenges. In some types of mobile device, however, known multi-band embedded antenna structures and design techniques provide relatively poor communication signal radiation and reception in one or more operating frequency bands.

SUMMARY

According to an aspect of the invention, a multiple-element antenna for a multi-band wireless mobile communication device comprises a first antenna element having a first operating frequency band, a second antenna element having a second operating frequency band and positioned adjacent the first antenna element, and a parasitic coupler positioned adjacent the first antenna element and the second antenna element.

A multiple-element antenna for use with a wireless mobile communication device having a first transceiver and a second transceiver, in accordance with another aspect of the invention, comprises a single dielectric substrate, a first antenna element on the single dielectric substrate and configured to be connected to the first transceiver, a second antenna element on the single dielectric substrate and configured to be connected to the second transceiver, and a parasitic coupler positioned on the single dielectric substrate adjacent the first antenna element and the second antenna element.

DETAILED DESCRIPTION

In a multiple-element antenna, different antenna elements are typically tuned to different operating frequency bands, thus enabling a multiple-element antenna to function as the antenna in a multi-band mobile communication device. For example, suitably tuned antenna elements enable a multiple-element antenna for operation at the Global System for Mobile Communications (GSM) and General Packet Radio Service (GPRS) frequency bands at approximately 900 MHz and 1800 MHz or 1900 MHz, the Code Division Multiple Access (CDMA) frequency bands of 800 Mhz and 1900 Mhz, or some other pair of operating frequency bands. A multiple-element antenna may also include further antenna elements to provide for operation in more than two frequency bands.

Figure 1:
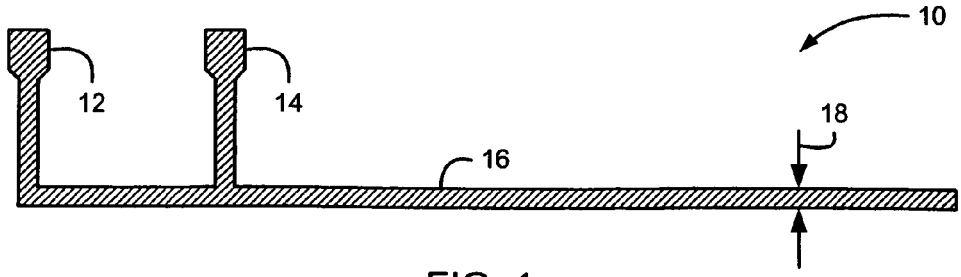
FIG. 1 is a top view of a first antenna element.

FIG. 1 is a top view of a first antenna element. The first antenna element 10 includes a first port 12, a second port 14, and a top conductor section 16 connected to the ports 12 and 14. As will be apparent to those skilled in the art, the ports 12 and 14 and the top conductor section 16 are normally fabricated from conductive material such as copper, for example. The length of the top conductor section 16 sets an operating frequency band of the first antenna element 10.

The ports 12 and 14 are configured to be connected to communications circuitry. In one embodiment, the port 12 is connected to a ground plane, while the port 14 is connected to a signal source. The ground and signal source connections may be reversed in alternate embodiments, with the port 12 being connected to a signal source and the port 14 being grounded. Although not shown in FIG. 1, those skilled in the art will also appreciate that either or both ports 12 and 14 may be connected to a matching network, in order to match impedance of the first antenna element 10 with the impedance of a communications circuit or device to which the antenna element 10 is connected.

Figure 2:
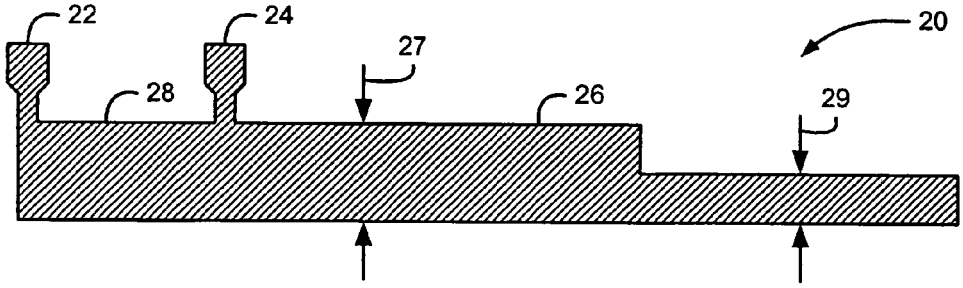
FIGS. 2–4 are top views of alternative first antenna elements.
Figure 3:
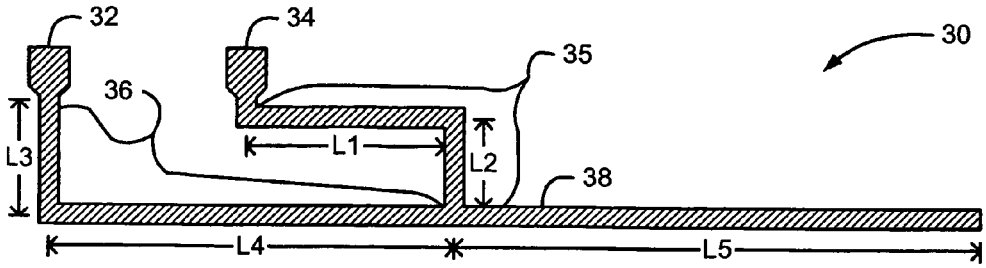
Figure 4:
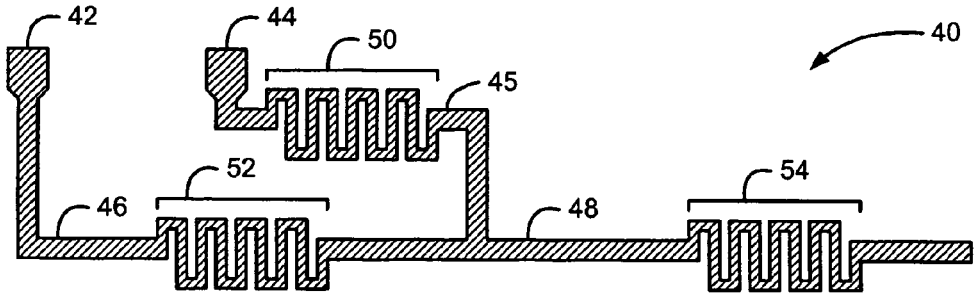

FIGS. 2–4 are top views of alternative first antenna elements. Whereas the top conductor section 16 of the first antenna element 10 has substantially uniform width 18, the alternative first antenna element 20 shown in FIG. 2 has a top conductor section 26 with non-uniform width. As shown in FIG. 2, the portion 28 and part of the top conductor portion 26 of the antenna element 20 have a width 27, and an end portion of the antenna element 20 has a smaller width 29. A structure as shown in FIG. 2 is useful, for example, to provide space for other antenna elements, such as a parasitic coupler, in order to conserve space. As those skilled in the art will appreciate, the length and width of the antenna element 20 or portions thereof are selected to set gain, bandwidth, impedance match, operating frequency band, and other characteristics of the antenna element.

FIG. 3 shows a top view of a further alternative first antenna element. The antenna element 30 includes ports 32 and 34, and first, second and third conductor sections 35, 36 and 38. The operating frequency band of the antenna element 30 is primarily controlled by selecting the lengths of the second and third conductor sections 36 and 38. As shown, any of the lengths L3, L4 and L5 may be adjusted to set the lengths of the second and third conductor sections 36 and 38, whereas the length of the first conductor section 35 may be set for impedance matching purposes by adjusting the lengths L1, L2, or both. Although the lengths of the first, second and third conductor sections are adjusted to control the above operating characteristics of the antenna element 30, adjustment of the length of any of these conductor sections has some effect on the characteristic controlled primarily by the other antenna conductor sections. For example, increasing L3, L4 or L5 to decrease the operating frequency band of the antenna element 30 may also necessitate adjustment of one or both of the lengths L1 and L2, since changing L3, L4 or L5 also affects the impedance and thus the matching of the antenna element 30.

Any of the first, second and third conductor sections of the antenna element 30 may include a structure to increase its electrical length, such as a meandering line or sawtooth pattern, for example. FIG. 4 is a top view of another alternative first antenna element, similar to the antenna element 30, including ports 42 and 44 and meandering lines 50, 52 and 54 to increase the electrical length of the first, second and third conductor sections 45, 46 and 48. The meandering lines 52 and 54 change the lengths of the second and third conductor sections 46 and 48 of the first antenna element 40 in order to tune it to a particular operating frequency band. The meandering line 54 also top-loads the first antenna element 40 such that it operates as though its electrical length were greater than its actual physical dimension. The meandering line 50 similarly changes the electrical length of the first conductor section 45 for impedance matching. The electrical length of the any of the meandering lines 50, 52 and 54, and thus the total electrical length of the first, second and third conductor sections 45, 46 and 48, may be adjusted, for example, by connecting together one or more segments of the meandering lines to form a solid conductor section.

Figure 5:
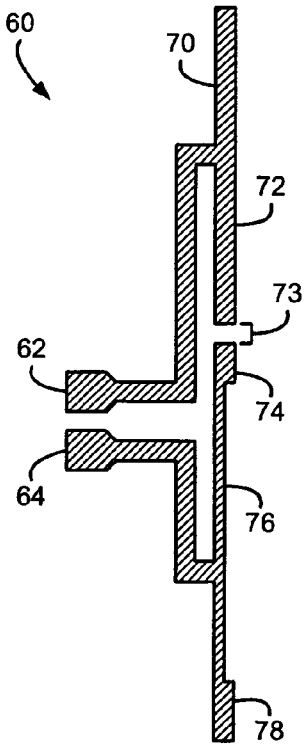
FIG. 5 is a top view of a second antenna element.

Referring now to FIG. 5, a top view of a second antenna element is shown. The second antenna element 60 includes a first conductor section 72 and a second conductor section 76. The first and second conductor sections 72 and 76 of the second antenna element 60 are positioned to define a gap 73, thus forming an open-loop structure known as an open folded dipole antenna. In alternative embodiments, other antenna designs may be utilized, such as a closed folded dipole structure, for example.

The first conductor section 72 of the second antenna element 60 includes a top load 70 that is used to set an operating frequency band of the second antenna element 60. This operating frequency band may be a relatively wide frequency band containing multiple operating frequency bands such as 1800 MHz and 1900 MHz. The dimensions of the top load 70 affect the total electrical length of the second antenna element 60, and thus may be adjusted to tune the second antenna element 60. For example, decreasing the size of the top load 70 increases the frequency of the operating frequency band of the second antenna element 60 by decreasing its total electrical length. In addition, the frequency of the operating frequency band of the second antenna element 60 may be further tuned by adjusting the size of the gap 73 between the conductor sections 72 and 76, or by altering the dimensions of other portions of the second antenna element 60.

The second conductor section 76 includes a stability patch 74 and a load patch 78. The stability patch 74 is a controlled coupling patch which affects the electromagnetic coupling between the first and second conductor sections 72 and 76 in the operating frequency band of the second antenna element 60. The electromagnetic coupling between the conductor sections 72 and 76 is further affected by the size of the gap 73, which is selected in accordance with desired antenna characteristics. Similarly, the dimensions of the load patch 78 affect the electromagnetic coupling with the first antenna element, as described in further detail below, and thus may enhance the gain of the second antenna element 60 at its operating frequency band.

Figure 10:
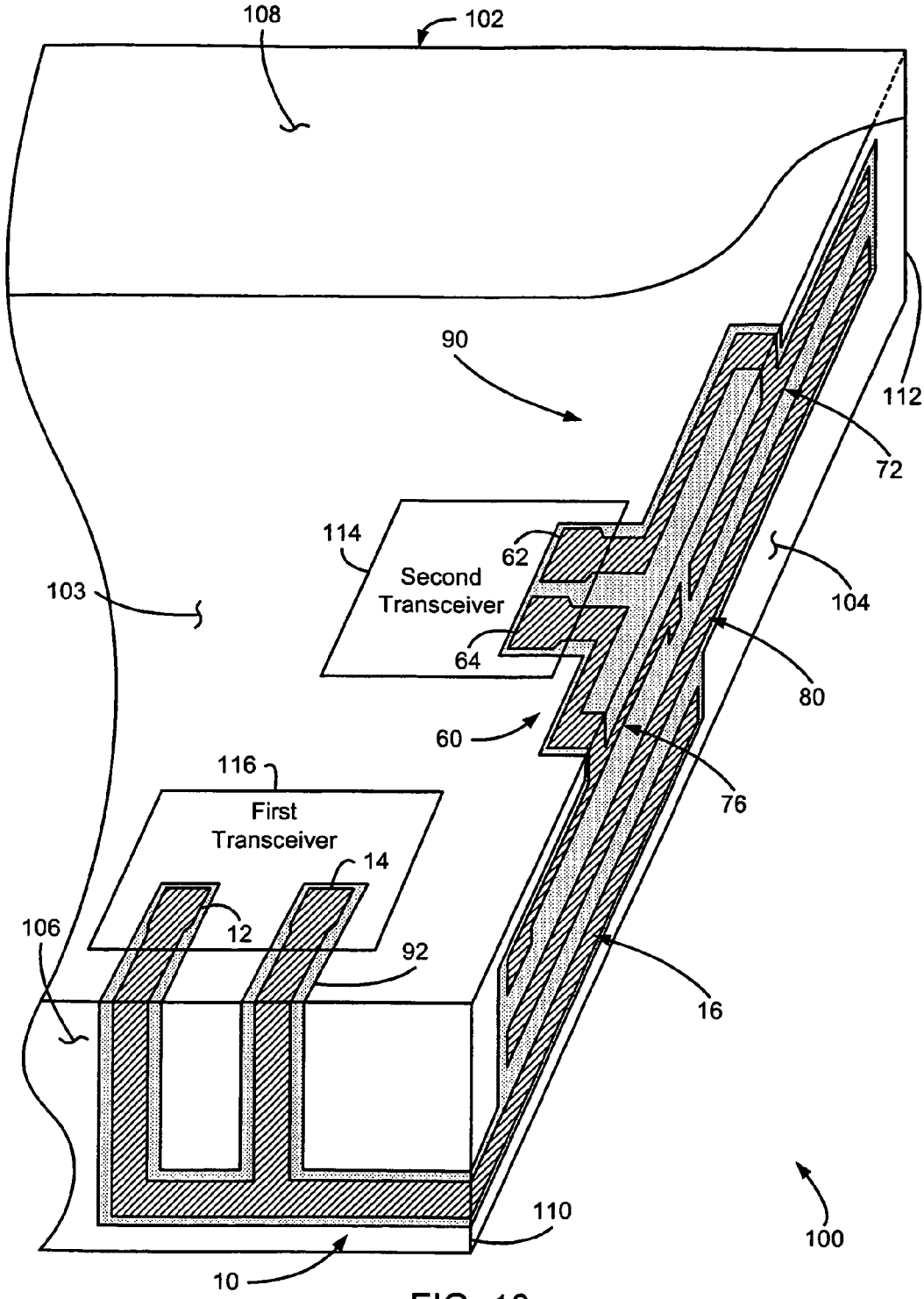
FIG. 10 is an orthogonal view of the multiple-element antenna shown in FIG. 8 mounted in a mobile communication device.

The second antenna element 60 also includes two ports 62 and 64, one connected to the first conductor section 72 and the other connected to the second conductor section 76. The ports 62 and 64 are offset from the gap 73 between the conductor sections 72 and 76, resulting in a structure commonly referred to as an "offset feed" open folded dipole antenna. However, the ports 62 and 64 need not necessarily be offset from the gap 73, and may be positioned, for example, to provide space for, or so as not to physically interfere with, other components of a mobile device in which the second antenna element is implemented. The ports 62 and 64 are configured to connect the second antenna element 60 to communications circuitry. For example, the ports 62 and 64 may connect the second antenna element 60 to a transceiver in a mobile device, as illustrated in FIG. 10 and described below.

Figure 6:
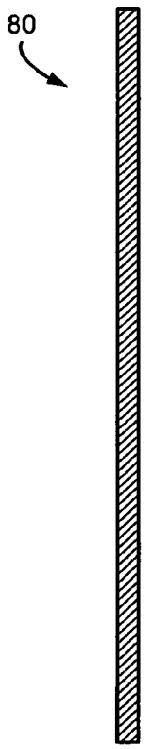
FIG. 6 is a top view of a parasitic coupler.

FIG. 6 is a top view of a parasitic coupler. The parasitic coupler 80 in FIG. 6 is a single conductor which, as described in further detail below, improves electromagnetic coupling between the first and second antenna elements in a multiple-element antenna, improves the performance of each antenna in its respective operating frequency band, and smoothes current distributions in the antenna elements.

Figure 7:
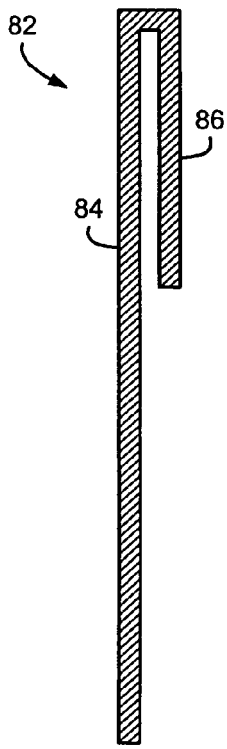
FIG. 7 is a top view of an alternative parasitic coupler.

A parasitic coupler need not necessarily be a substantially straight conductor as shown in FIG. 6. FIG. 7 is a top view of an alternative parasitic coupler. The parasitic coupler 82 is a folded or curved conductor which has a first conductor section 84 and a second conductor section 86. A parasitic coupler such as 82 may be used, for example, when different parts of the parasitic coupler are intended to electromagnetically couple with different antenna elements in a multiple-element antenna, as described below in conjunction with FIG. 9, or where physical space limitations exist.

It should also be appreciated that a parasitic coupler may alternatively comprise adjacent, connected or disconnected, conductor sections. For example, two conductor sections of the type shown in FIG. 6 could be juxtaposed so that they overlap along substantially their entire lengths to form a "stacked" parasitic coupler. In a variation of a stacked parasitic coupler, the conductor sections only partially overlap, to form an offset stacked parasitic element. End-to-end stacked conductor sections represent a further variation of multiple-conductor section parasitic couplers. Other parasitic coupler patterns or structures, adapted to be accommodated within available physical space or to achieve particular electromagnetic coupling and performance characteristics, will also be apparent to those skilled in the art.

Figure 8:
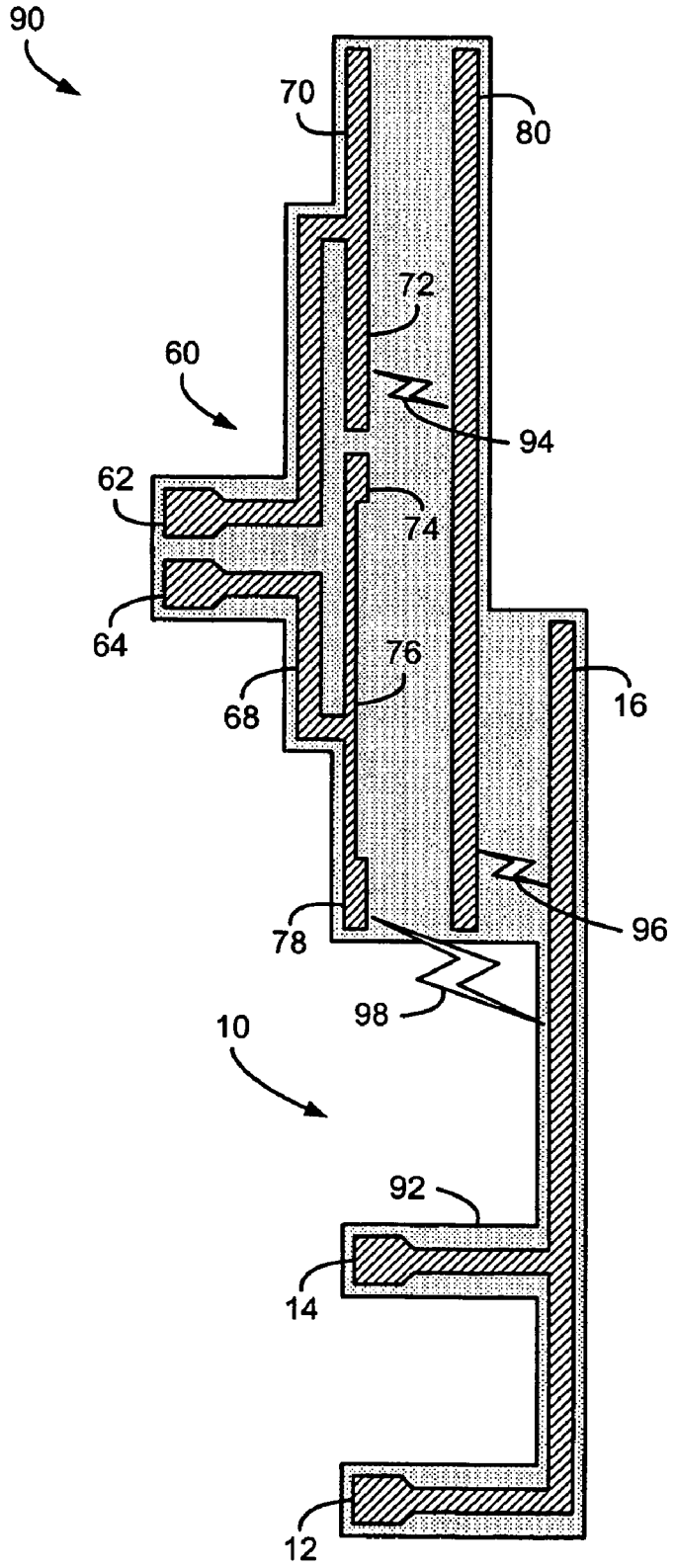
FIG. 8 is a top view of a multiple-element antenna.

FIG. 8 is a top view of a multiple-element antenna having two antenna elements and a parasitic element. In the multiple-element antenna 90, a first antenna element 10 as shown in FIG. 1 is positioned in close proximity to a second antenna element 60 such that at least a portion of the first antenna element 10 is adjacent at least a portion of the second antenna element 60. This relative positioning of the first antenna element 10 and the second antenna element 60 electromagnetically couples the first antenna element 10 with the second antenna element 60. A parasitic coupler 80 is positioned in close proximity to the first antenna element 10 and the second antenna element 60 in order to electromagnetically couple with both the first antenna element 10 and the second antenna element 60. It will be apparent to those skilled in the art that the dimensions such as electrical length of the parasitic coupler 80 determine its electromagnetic coupling characteristics when the multiple-element antenna 90 is operating in any of its operating frequency bands. Thus, the dimensions of the parasitic coupler 80 are selected to achieve desired coupling between antenna elements in each operating frequency band.

The multiple-element antenna 90 is fabricated on a flexible dielectric substrate 92, using copper conductor and known copper etching techniques, for example. The antenna elements 10 and 60 are fabricated such that a portion of the top conductor section 16 of the first antenna element 10 is adjacent to and partially overlaps the second conductor section 76 of the second antenna element 60. The proximity of the first antenna element 10 and the second antenna element 60 results in electromagnetic coupling between the two antenna elements 10 and 60, as indicated at 98. In this manner, each antenna element 10 and 60 acts as a parasitic element to the other antenna structure 10 and 60, thus improving performance of the multiple-element antenna 90 by smoothing current distributions in each antenna element 10 and 60 and increasing the gain and bandwidth at the operating frequency bands of both the first and second antenna elements 10 and 60. As described above, the first and second antenna elements may be respectively tuned to first and second operating frequency bands. For example, in a mobile device designed for operation in a GPRS network, the first operating frequency band is preferably GSM-900 (900 MHz), whereas the second operating frequency band includes both the GSM-1800 (1800 MHz), also known as DCS, and GSM-1900 (1900 MHz), sometimes referred to as PCS, frequency bands. In a mobile device for a CDMA network, the first and second operating frequency bands may be 800 Mhz and 1900 Mhz. For communication networks utilizing different frequencies, those skilled in the art will appreciate that the first and second antenna elements 10 and 60 are tuned to other first and second operating frequency bands.

The parasitic coupler 80 is fabricated at a location adjacent to, and partially overlaps, both the first antenna element 10 and the second antenna element 60. Resultant electromagnetic coupling between the parasitic coupler 80 and the first and second antenna elements 10 and 60, as shown at 94 and 96, further improves the performance of the antenna 90.

The first antenna element 10, as described above, may exhibit relatively poor communication signal radiation and reception in some types of mobile devices when conventional design techniques are employed. Particularly when implemented in a small wireless mobile communication device, the length of the top conductor section 16 of such an antenna is limited by the physical dimensions of the mobile device, which can result in poor gain. The presence of the parasitic coupler 80 enhances electromagnetic coupling between the first antenna element 10 and the second antenna element 60. Since the second antenna element 60 generally has better gain than the first antenna element 10, this enhanced electromagnetic coupling to the second antenna element 60 improves the gain of the first antenna element 10 at its first operating frequency band. When operating in its first operating frequency band, the first antenna element 10 electromagnetically couples to the second conductor section 76 of the second antenna element 60, as shown at 98, and electromagnetically couples to the first conductor section 72 of the second antenna element 60 through the parasitic coupler 80, as shown at 96 and 94.

The parasitic coupler 80 also improves performance of the second antenna element 60 at its second operating frequency band. In particular, the parasitic coupler 80, through its electromagnetic coupling with the second antenna element 60 as indicated at 94, provides a further conductor to which current in the second antenna element 60 may effectively be transferred, resulting in a more even current distribution in the second antenna element 60. Electromagnetic coupling from both the second antenna element 60 and the parasitic coupler 80 to the first antenna element 10 can also disperse current in the second antenna element 60 and the parasitic coupler 80. This provides for an even greater capacity for smoothing current distribution in the second antenna element 60, in that current can effectively be transferred to both the parasitic coupler 80 and the first antenna element 10 when the second antenna element 60 is in operation, for example when a communication signal is being transmitted.

The length of the parasitic coupler 80, as well as the spacing between the first and second antenna elements 10 and 60 and the parasitic coupler 80, control the electromagnetic coupling between the antenna elements 10 and 60 and the parasitic coupler 80. These dimensions are adjusted to control the gain and bandwidth of the first antenna element 10 and the second antenna element 60 of the antenna 90 within their respective first and second operating frequency bands. Although the first antenna element 10, the second antenna element 60 and the parasitic coupler 80 are shown in FIG. 8 as partially overlapping, it will be apparent that in alternative embodiments, these elements overlap to a greater or lesser degree. Therefore, other structures than the particular structure shown in FIG. 8 are also possible.

With respect to the second antenna element 60 of the antenna 90, the gain is further controllable by adjusting the dimensions of the stability patch 74 and the size of the gap 73 (FIG. 5) between the first and second conductor sections 72 and 76. For example, the gap 73 may be adjusted to tune the second antenna element 60 to a selected operating frequency band by optimizing antenna gain and performance at the operating frequency band. In addition, the dimensions of the stability patch 74 and gap 73 are selected to control the input impedance of the second antenna element 60 in order to optimize impedance matching between the second antenna element 60 and external circuitry, such as the transceiver illustrated in FIG. 10.

For the first antenna element 10 of the antenna 90, the gain is further controlled by adjusting the length of the top conductor section 16, by using a meandering line structure 54, for example, as shown in FIG. 4. In addition to adjusting the first operating frequency band of the first antenna element 10, the length of the top conductor section 16 also affects the gain of the first antenna element 10.

The dimensions, shapes and orientations of the various patches, gaps and other elements affecting the electromagnetic coupling between the first and second antenna elements 10 and 60 and the parasitic coupler 80 are shown for illustrative purposes only, and may be modified to achieve desired antenna characteristics. Although the first antenna element 10 is shown in the multiple-element antenna 90, any of the alternative antenna elements 20, 30 and 40, or a first antenna element combining some of the features of these alternative first antenna elements, could be used instead of the first antenna element 10. Other forms of the second antenna element 60 and the parasitic coupler 80 may also be used in alternative embodiments.

Figure 9:
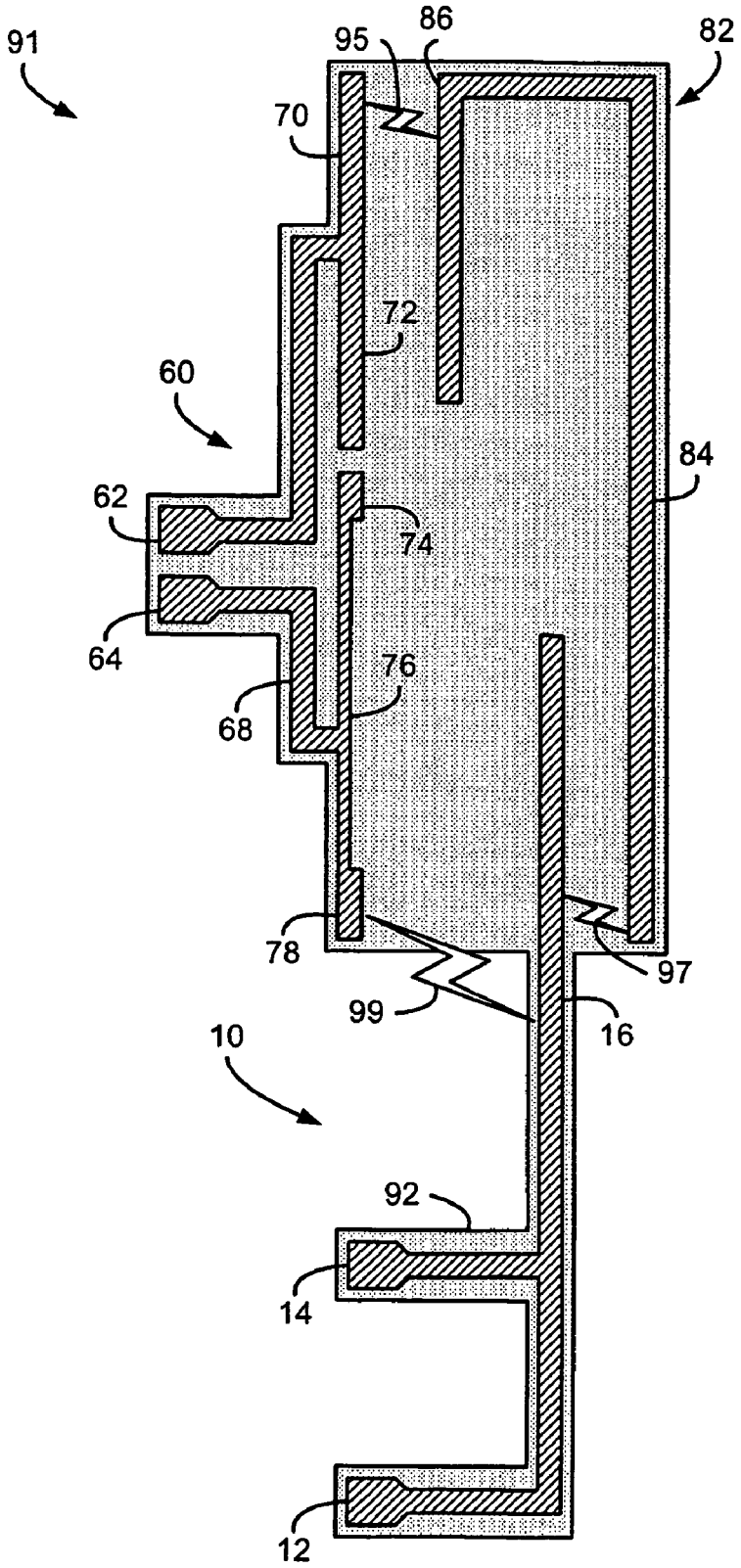
FIG. 9 is a top view of a further multiple-element antenna.

FIG. 9 is a top view of a further multiple-element antenna, in which a different structure of parasitic coupler is implemented. The multiple-element antenna 91 includes the first and second antenna elements 10 and 60, described above, and a parasitic coupler 82 having a structure as shown in FIG. 7. The parasitic coupler 82 comprises a folded conductor having a first conductor section 84 and a second conductor section 86. In the multiple-element antenna 91, the first conductor section 84 of the parasitic coupler 82 is positioned adjacent to and overlaps a portion of the first antenna element 10 in order to electromagnetically couple the parasitic coupler 82 with the first antenna element 10, as shown at 97. The second conductor section 86 of the parasitic coupler 82 is positioned adjacent to and overlaps a portion of the second antenna element 60 in order to electromagnetically couple the parasitic coupler 82 with the second antenna element 60, as indicated at 95.

Although the first and second antenna elements 10 and 60 are electromagnetically coupled in the multiple-element antenna 91, as indicated at 99, the coupling between these elements is not as strong as in the antenna 90. In the antenna 90, the parasitic coupler 80 is positioned between the first and second antenna elements 10 and 60 and therefore acts a bridge to tightly couple the first and second antenna elements 10 and 60. In the antenna 91, however, the parasitic coupler is not positioned between the first and second antenna elements 10 and 60, such that electromagnetic coupling between the first and second antenna elements 10 and 60 is weaker. The antenna 91 may be useful, for example, when some degree of isolation between the first and second antenna elements 10 and 60 is desired. Operation of the antenna 91 is otherwise substantially as described above for the antenna 90.

FIG. 10 is an orthogonal view of the multiple-element antenna shown in FIG. 8 mounted in a mobile communication device. Those skilled in the art will appreciate that a front housing wall and a majority of internal components of the mobile device 100, which would obscure the view of the antenna, have not been shown in FIG. 10. In an assembled mobile device, the embedded antenna shown in FIG. 10 is not visible.

The mobile device 100 comprises a case or housing having a front wall (not shown), a rear wall 103, a top wall 108, a bottom wall 106, and side walls, one of which is shown at 104. In addition, the mobile device 100 includes a first transceiver 116 and a second transceiver 114 mounted within the housing. A portion of the top wall 108 is broken away to reveal the portion of the antenna 90 located behind that wall in the view shown in FIG. 10.

The multiple-element antenna structure 90, including the flexible dielectric substrate 92 on which the antenna 90 is fabricated, is mounted on the inside of the housing 102. The substrate 92 and thus the multiple-element antenna are folded from the original, flat configuration illustrated in FIG. 8, such that they extend around the inside surface of the mobile device housing 102 to orient the antenna structure 90 in multiple planes. The top conductor section 16 of the first antenna element 10 is mounted on the side wall 104 of the housing 102 and extends from the side wall 104 around a bottom corner 110 to the bottom wall 106. The ports 12 and 14 are mounted on the rear wall 103 of the housing 102 and connected to the first transceiver 116.

The second antenna element 60 of the antenna 90 is similarly folded and mounted across the side and rear walls 104 and 103 of the housing 102, such that the ports 62 and 64 are mounted on the rear wall 103 and the first and second conductor sections 72 and 76 are mounted on the side wall 104. The feeding ports 62 and 64 are positioned on the rear wall 103 of the housing 102 and connected to the second transceiver 114.

The parasitic coupler 80 is positioned on the side wall 104. A portion of the parasitic coupler 80 lies between the top conductor section 16 of the first antenna element 10 and the second conductor portion 76 of the second antenna element 60.

Although FIG. 10 shows the orientation of the multiple-element antenna within the mobile device 100, it should be appreciated that the antenna may be mounted in different ways, depending upon the type of housing, for example. In a mobile device with substantially continuous top, side, and bottom walls, an antenna may be mounted directly to the housing. Many mobile device housings are fabricated in separate parts that are attached together when internal components of the mobile device have been placed. Often, the housing sections include a front section and a rear section, each including a portion of the top, side and bottom walls of the housing. Unless the portion of the top, side, and bottom walls in the rear housing section is of sufficient size to accommodate the antenna and the substrate, then mounting of the antenna as shown in FIG. 10 might not be practical. In such mobile devices, the antenna is preferably attached to an antenna frame that is integral with or adapted to be mounted inside the mobile device, a structural member in the mobile device, or another component of the mobile device. Where the antenna is fabricated on a substrate, mounting or attachment of the antenna is preferably accomplished using an adhesive provided on or applied to the substrate, the component to which the antenna is mounted or attached, or both.

The mounting of the multiple-element antenna 90 as shown in FIG. 10 is intended for illustrative purposes only. The multiple-element antenna 90 or other similar antenna structures may be mounted on different surfaces of a mobile device or mobile device housing. For example, housing surfaces on which a multiple element antenna is mounted need not necessarily be flat, perpendicular, or any particular shape. An antenna may also be mounted on fewer or further surfaces or planes, and may, for example, extend around the corner 112 and onto the top wall 108 of the housing 102.

The ports 12 and 14 of the first antenna element 10 are connected to the first transceiver 116, and the feeding ports 62 and 64 of the second antenna element 60 are connected to the second transceiver 114. The operation of the mobile device 100, along with the first and second transceivers, is described in more detail below with reference to FIG. 11.

A mobile device in which a multiple-element antenna is implemented may, for example, be a data communication device, a voice communication device, a dual-mode communication device such as a mobile telephone having data communications functionality, a personal digital assistant (PDA) enabled for wireless communications, a wireless email communication device, or a wireless modem operating in conjunction with a laptop or desktop computer or some other electronic device or system.

Figure 11:
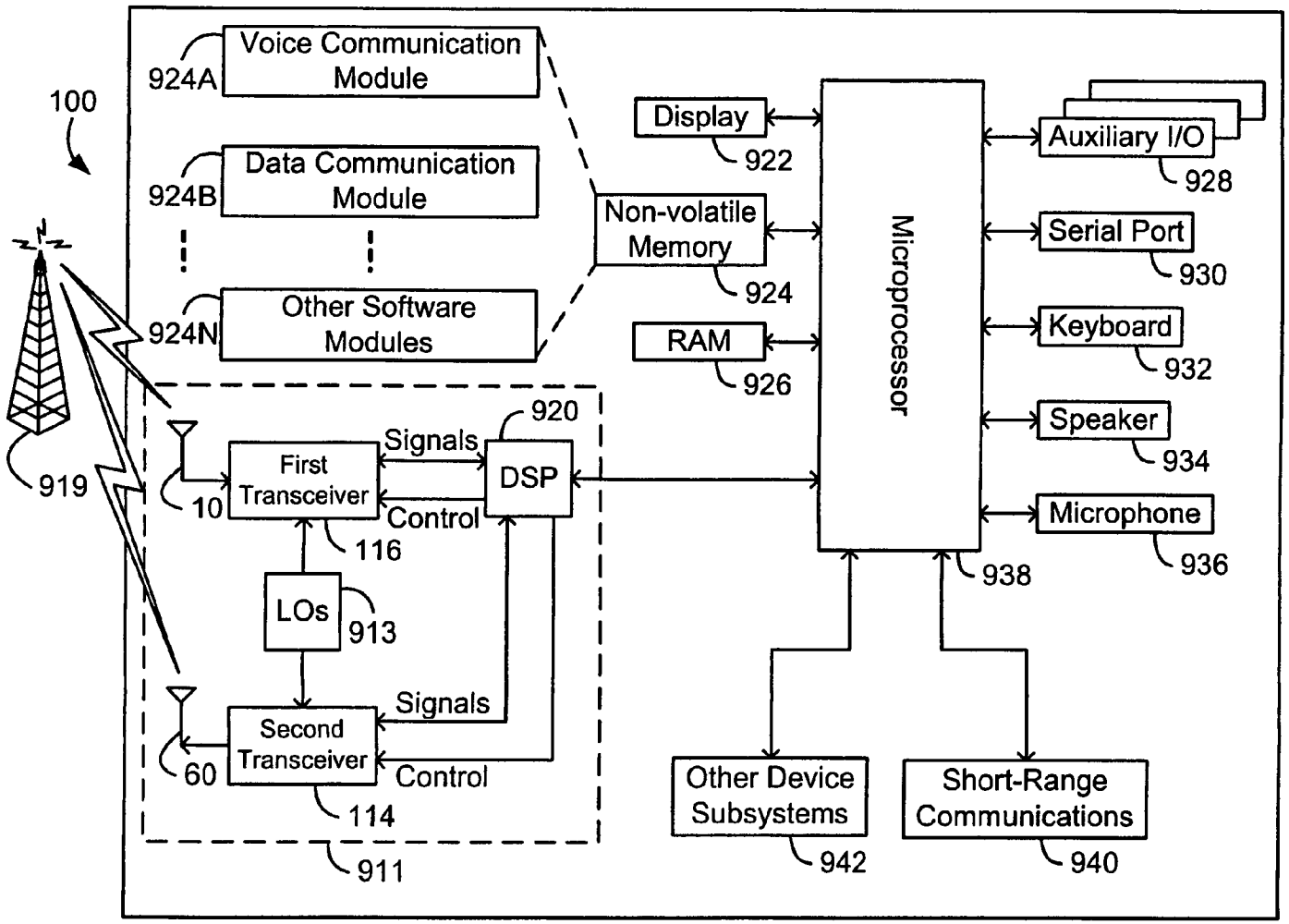
FIG. 11 is a block diagram of a mobile communication device.

FIG. 11 is a block diagram of a mobile communication device. The mobile device 100 is a dual-mode mobile device and includes a transceiver module 911, a microprocessor 938, a display 922, a non-volatile memory 924, random access memory (RAM) 926, one or more auxiliary input/ output (I/O) devices 928, a serial port 930, a keyboard 932, a speaker 934, a microphone 936, a short-range wireless communications sub-system 940, and other device sub-systems 942.

The transceiver module 911 includes first and second antenna elements 10 and 60, the first transceiver 116, the second transceiver 114, one or more local oscillators 913, and a digital signal processor (DSP) 920. The antenna elements 10 and 60 are the first and second antenna elements of a multiple-element antenna, which also includes a parasitic coupler (not shown), such as the parasitic coupler 80 or 82 described above.

Within the non-volatile memory 924, the mobile device 100 preferably includes a plurality of software modules 924A–924N that can be executed by the microprocessor 938 (and/or the DSP 920), including a voice communication module 924A, a data communication module 924B, and a plurality of other operational modules 924N for carrying out a plurality of other functions.

The mobile device 100 is preferably a two-way communication device having voice and data communication capabilities. Thus, for example, the mobile device 100 may communicate over a voice network, such as any of the analog or digital cellular networks, and may also communicate over a data network. The voice and data networks are depicted in FIG. 11 by the communication tower 919. These voice and data networks may be separate communication networks using separate infrastructure, such as base stations, network controllers, etc., or they may be integrated into a single wireless network. Each transceiver 114 and 116 is normally configured to communicate with different networks 919.

The transceiver module 911 is used to communicate with the networks 919, and includes the first transceiver 116, the second transceiver 114, the one or more local oscillators 913, and the DSP 920. The DSP 920 is used to send and receive communication signals to and from the transceivers 114 and 116, and provides control information to the transceivers 114 and 116. If the voice and data communications occur at a single frequency, or closely-spaced sets of frequencies, then a single local oscillator 913 may be used in conjunction with the transceivers 114 and 116. Alternatively, if different frequencies are utilized for voice communications versus data communications, for example, then a plurality of local oscillators 913 can be used to generate a plurality of corresponding frequencies. Information, which includes both voice and data information, is communicated to and from the transceiver module 911 via a link between the DSP 920 and the microprocessor 938.

The detailed design of the transceiver module 911, such as operating frequency bands, component selection, power level, etc., is dependent upon the communication network or networks 919 in which the mobile device 100 is intended to operate. For example, in a mobile device intended to operate in a North American market, the transceiver 114 may be designed to operate with any of a variety of voice communication networks, such as the Mobitex™ or DataTAC™ mobile data communication networks, AMPS, TDMA, CDMA, PCS, etc., whereas the transceiver 116 is configured to operate with the GPRS data communication network and the GSM voice communication network in North America an possibly other geographical regions. Alternatively, each transceiver 114 and 116 is configured to operate within a different operating frequency band associated with the same or related types of networks, such as GSM and GPRS networks, or different operating frequency bands for CDMA networks, as described above. Other types of data and voice networks, both separate and integrated, may also be utilized with a mobile device 100.

Depending upon the type of network or networks 919, the access requirements for the mobile device 100 may also vary. For example, in the Mobitex and DataTAC data networks, mobile devices are registered on the network using a unique identification number associated with each mobile device. In GPRS data networks, however, network access is associated with a subscriber or user of a mobile device. A GPRS device typically requires a subscriber identity module ("SIM") in order to operate a mobile device on a GPRS network. Local or non-network communication functions (if any) may be operable, without the SIM device, but a mobile device will be unable to carry out any functions involving communications over the communication network(s) 919, other than any legally required operations, such as '911' emergency calling.

After any required network registration or activation procedures have been completed, the mobile device 100 may the send and receive communication signals, including both voice and data signals, over the networks 919. Signals received by the antenna elements 10 and 60 are routed to the transceivers 114 and 116, which provide for signal amplification, frequency down conversion, filtering, and channel selection, for example, as well as analog to digital conversion. Analog to digital conversion of the received signal allows more complex communication functions, such as digital demodulation and decoding to be performed using the DSP 920. In a similar manner, signals to be transmitted from the mobile device 100 are processed, including modulation and encoding, for example, by the DSP 920 and are then provided to one of the transceivers 114 and 116 for digital to analog conversion, frequency up conversion, filtering, amplification, and then transmission via its associated antenna element 10 or 60.

In addition to processing the communication signals, the DSP 920 also provides for transceiver control. For example, the gain levels applied to communication signals in the transceivers 114 and 116 may be adaptively controlled through automatic gain control algorithms implemented in the DSP 920. Other transceiver control algorithms could also be implemented in the DSP 920 in order to provide more sophisticated control of the transceiver module 911.

The microprocessor 938 preferably manages and controls the overall operation of the dual-mode mobile device 100. Many types of microprocessors or microcontrollers could be used here, or, alternatively, a single DSP 920 could be used to carry out the functions of the microprocessor 938. Low-level communication functions, including at least data and voice communications, are performed through the DSP 920 in the transceiver module 911. Other, high-level communication applications, such as a voice communication application 924A, and a data communication application 924B may be stored in the non-volatile memory 924 for execution by the microprocessor 938. For example, the voice communication module 924A provides a high-level user interface operable to transmit and receive voice calls between the mobile device 100 and a plurality of other voice or dual-mode devices via the network or networks 919. Similarly, the data communication module 924B provides a high-level user interface operable for sending and receiving data, such as e-mail messages, files, organizer information, short text messages, etc., between the mobile device 100 and a plurality of other data devices. The microprocessor 938 also interacts with other device subsystems, such as the display 922, the non-volatile memory 924, the RAM 926, the auxiliary input/output (I/O) subsystems 928, the serial port 930, the keyboard 932, the speaker 934, the microphone 936, the short-range communications subsystem 940 and any other device subsystems generally designated as 942.

Some of the subsystems shown in FIG. 11 perform communication-related functions, whereas other subsystems may provide "resident" or on-device functions. Notably, some subsystems, such as the keyboard 932 and the display 922 are used for both communication-related functions, such as entering a text message for transmission over a data communication network, and device-resident functions such as a calculator, task list, or other PDA type functions.

Operating system software used by the microprocessor 938 is preferably stored in a persistent store such as the non-volatile memory 924. In addition to the operation system, which controls all of the low-level functions of the mobile device 910, the non-volatile memory 924 may include a plurality of high-level software application programs, or modules, such as the voice communication module 924A, the data communication module 924B, an organizer module (not shown), or any other type of software module 924N. These software modules are executed by the microprocessor 938 and provide a high-level interface between a user and the mobile device 100. This interface typically includes a graphical component provided through the display 922, and an input/output component provided through the auxiliary I/0 928, the keyboard 932, the speaker 934, and the microphone 936. The operating system, specific device applications or modules, or parts thereof, may be temporarily loaded into a volatile store such as the RAM 926 for faster operation. Moreover, received communication signals may also be temporarily stored to the RAM 926, before permanently writing them to a file system located in a persistent store such as the non-volatile memory 924. The non-volatile memory 924 may be implemented, for example, as a Flash memory component, or a battery backed-up RAM.

An exemplary application module 924N that may be loaded onto the mobile device 100 is a personal information manager (PIM) application providing PDA functionality, such as calendar events, appointments, and task items. This module 924N may also interact with the voice communication module 924A for managing phone calls, voice mails, etc., and may also interact with the data communication module for managing e-mail communications and other data transmissions. Alternatively, all of the functionality of the voice communication module 924A and the data communication module 924B may be integrated into the PIM module.

The non-volatile memory 924 preferably provides a file system to facilitate storage of PIM data items and other data on the mobile device 100. The PIM application preferably includes the ability to send and receive data items, either by itself, or in conjunction with the voice and data communication modules 924A and 924B, via the wireless networks 919. The PIM data items are preferably seamlessly integrated, synchronized and updated, via the wireless networks 919, with a corresponding set of data items stored or associated with a host computer system, thereby creating a mirrored system for data items associated with a particular user.

The mobile device 100 may also be manually synchronized with a host system by placing the device 100 in an interface cradle, which connects the serial port 930 of the mobile device 100 to the serial port of the host system. The serial port 930 may also be used to enable a user to set preferences through an external device or software application, or to download other application modules 924N for installation. This wired download path may be used to load an encryption key onto the device, which is a more secure method than exchanging encryption information over a wireless communication link. Interfaces for other wired download paths may be provided in the mobile device 100, in addition to or instead of the serial port 930. For example, a Universal Serial Bus (USB) port provides an interface to a similarly equipped personal computer or other device.

Additional software application modules 924N may be loaded onto the mobile device 100 through a network 919, through an auxiliary I/O subsystem 928, through the serial port 930, through the short-range communications subsystem 940, or through any other suitable subsystem 942, and installed by a user in the non-volatile memory 924 or the RAM 926. Such flexibility in software application installation increases the functionality of the mobile device 100 and may provide enhanced on-device functions, communication-related functions, or both. For example, secure communication applications enable electronic commerce functions and other such financial transactions to be performed using the mobile device 100.

When the mobile device 100 is operating in a data communication mode, a received signal, such as a text message or a web page download, is processed by the transceiver module 911 and provided to the microprocessor 938, which preferably further processes the received signal for output to the display 922, or, alternatively, to an auxiliary I/O device 928. A user of mobile device 100 may also compose data items, such as email messages, using the keyboard 932, which is preferably a complete alphanumeric keyboard laid out in the QWERTY style, although other styles of keyboards such as the known DVORAK keyboard or a telephone keypad may also be used. User input to the mobile device 100 is further enhanced with a plurality of auxiliary I/O devices 928, which may include a thumbwheel input device, a touchpad, a variety of switches, a rocker input switch, etc. The composed data items input by the user may then be transmitted via the transceiver module 911.

When the mobile device 100 is operating in a voice communication mode, the overall operation of the mobile device is substantially similar to the data mode, except that received signals are preferably be output to the speaker 934 and voice signals for transmission are generated by a microphone 936. Alternative voice or audio I/O subsystems, such as a voice message recording subsystem, may also be implemented on the mobile device 100. Although voice or audio signal output is preferably accomplished primarily through the speaker 934, the display 922 may also be used to provide an indication of the identity of a calling party, the duration of a voice call, or other voice call related information. For example, the microprocessor 938, in conjunction with the voice communication module and the operating system software, may detect the caller identification information of an incoming voice call and display it on the display 922.

A short-range communications subsystem 940 is also included in the mobile device 100. For example, the subsystem 940 may include an infrared device and associated circuits and components, or a short-range RF communication module such as a Bluetooth™ module or an 802.11 module to provide for communication with similarly-enabled systems and devices. Those skilled in the art will appreciate that "Bluetooth" and "802.11" refer to sets of specifications, available from the Institute of Electrical and Electronics Engineers, relating to wireless personal area networks and wireless local area networks, respectively.

This written description uses examples to disclose the invention, including the best mode, and also to enable any person skilled in the art to make and use the invention. The invention may include other examples that occur to those skilled in the art.

It is claimed:

1. A mobile device, comprising:

a first transceiver configured to communicate at a first frequency band;

a second transceiver configured to communicate at a second frequency band; and a multiple-element antenna, including:

a first antenna element coupled to the first transceiver and configured to operate in the first frequency band;

a second antenna element coupled to the second transceiver and configured to operating in the second frequency band;

the second antenna element being physically separated from but positioned adjacent to the first antenna element to thereby electromagnetically couple the first and second antenna elements; and a parasitic coupler physically separated from both the first and second antenna elements but positioned adjacent to both to thereby electromagnetically couple the parasitic coupler to the first and second antenna elements.

2. The mobile device of claim 1, wherein the first antenna element, the second antenna element, and the parasitic coupler are positioned on a single substrate.

3. The mobile device of claim 2, wherein the substrate is a flexible dielectric substrate.

4. The mobile device of claim 1, wherein:

the first antenna element comprises a top conductor section; and a portion of the top conductor section is positioned adjacent the second antenna element and the parasitic coupler.

5. The mobile device of claim 1, wherein:

the first antenna element comprises a first port connected to a first conductor section, a second port connected to a second conductor section, and a third conductor section connected to the first conductor section and the second conductor section;

the first port and the second port are configured to connect the first antenna element to the first transceiver; and a portion of the third conductor section is positioned adjacent the second antenna element and the parasitic coupler.

6. The mobile device of claim 5, wherein:

the first conductor section has an electrical length;

the electrical length of the first conductor section is selected to match impedance of the first antenna element to impedance of the first transceiver;

the second conductor section has a second electrical length;

the third conductor section has a third electrical length; and the second electrical length and the third electrical length are selected to tune the first antenna element to the first operating frequency band.

7. The mobile device of claim 1, wherein the second antenna element is an open folded dipole antenna.

8. The mobile device of claim 1, wherein:

the second antenna element includes a top load; and dimensions of the top load are selected to tune the second antenna element to the second operating frequency.

9. The mobile device of claim 1, wherein the second antenna element includes a first conductor section and a second conductor section.

10. The mobile device of claim 9, wherein the first conductor section and the second conductor section define a gap.

11. The mobile device of claim 10, wherein a size of the gap is selected to set a gain of the second antenna element.

12. The mobile device of claim 9, wherein the parasitic coupler is positioned adjacent the first conductor section and the second conductor section.

13. The mobile device of claim 9, wherein the first antenna element is positioned adjacent one of the first conductor section and the second conductor section.

14. The mobile device of claim 13, wherein, when the first antenna element is operating in the first frequency band:

the first antenna element electromagnetically couples to the one of the first conductor section and the second conductor section; and the first antenna element electromagnetically couples to the other of the first conductor section and the second conductor section through the parasitic coupler.

15. The mobile device of claim 1, wherein, when the second antenna element is operating in the second frequency band, the second antenna element electromagnetically couples to both the parasitic coupler and the first antenna element.

16. The mobile device of claim 1, further comprising a third antenna element configured to operate in a third frequency band and positioned adjacent the parasitic coupler.

17. The mobile device of claim 16, wherein the third antenna element is positioned adjacent the second antenna element.

18. The mobile device of claim 16, wherein the third antenna element is positioned adjacent the first antenna element.

19. The mobile device of claim 1, wherein the parasitic coupler comprises a substantially straight conductor.

20. The mobile device of claim 1, wherein:

the parasitic coupler comprises a folded conductor having a first conductor section and a second conductor section;

the first conductor section is positioned adjacent the first antenna element; and the second conductor section is positioned adjacent the second antenna element.

21. The mobile device of claim 1, wherein the parasitic coupler comprises a plurality of stacked parasitic elements.

22. The mobile device of claim 21, wherein the plurality of stacked parasitic elements comprises a plurality of juxtaposed conductors.

23. The mobile device of claim 21, wherein the plurality of stacked parasitic elements comprises a plurality of end-to-end stacked conductors.

24. The mobile device of claim 21, wherein the plurality of stacked parasitic elements comprises a plurality of offset stacked, partially overlapping conductors.

25. A mobile device, comprising:

a first transceiver;

a second transceiver; and a multiple-element antenna, including:

a single dielectric substrate;

a first antenna element on the single dielectric substrate and connected to the first transceiver;

a second antenna element on the single dielectric substrate and connected to the second transceiver;

wherein the second antenna element is physically separated from but positioned adjacent to the first antenna element to thereby electromagnetically couple the first and second antenna elements; and a parasitic coupler physically separated from both the first and second antenna elements but positioned on the single dielectric substrate adjacent the first antenna element and the second antenna element to thereby electromagnetically couple the parasitic coupler to the first and second antenna elements.

26. The mobile device of claim 25, wherein the multiple-element antenna is mounted on at least one inside surface of the mobile device.

27. The mobile device of claim 25, wherein the mobile device is a dual-band wireless mobile communication device, and wherein the first antenna element is tuned to a first operating frequency band and the second antenna element is tuned to a second operating frequency band.

28. The mobile device of claim 25, wherein the mobile device is selected from the group consisting of: a data communication device, a voice communication device, a dual-mode communication device, a mobile telephone having data communications functionality, a personal digital assistant (PDA) enabled for wireless communications, a wireless email communication device, and a wireless modem.

29. The mobile device of claim 27, wherein the first operating frequency band comprises a 900 MHz communication frequency band, and wherein the second operating frequency band includes both an 1800 MHz communication frequency band and a 1900 MHz communication frequency band.

* * * * *